US009930961B2

(12) United States Patent
Kessell et al.

(10) Patent No.: US 9,930,961 B2
(45) **Date of Patent: *Apr. 3, 2018**

(54) ADJUSTABLE SHELVING SYSTEM

(71) Applicant: SPG INTERNATIONAL LLC, Covington, GA (US)

(72) Inventors: Steven M. Kessell, Loganville, GA (US); Douglas R. Dean, Snellville, GA (US); Gene B. Kartchner, Carl Junction, MO (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/933,869

(22) Filed: Nov. 5, 2015

(65) Prior Publication Data

US 2016/0051045 A1 Feb. 25, 2016

Related U.S. Application Data

(62) Division of application No. 14/171,097, filed on Feb. 3, 2014, now Pat. No. 9,179,774, which is a division (Continued)

(51) Int. Cl.
*A47B 43/00* (2006.01)
*A47B 47/00* (2006.01)
(Continued)

(52) U.S. Cl.
CPC ..... *A47B 57/562* (2013.01); *A47B 47/0083* (2013.01); *A47B 57/26* (2013.01); (Continued)

(58) Field of Classification Search
CPC ... A47B 96/068; A47B 47/0083; A47B 57/26; A47B 57/50; A47B 57/545; A47B 57/06; (Continued)

(56) References Cited

U.S. PATENT DOCUMENTS 3,273,847 A 9/1966 Berman
3,294,250 A 12/1966 Evans
(Continued)

FOREIGN PATENT DOCUMENTS

| | | |
|---|---|---|
| DE | 1138902 | 10/1962 |
| DE | 9109395 | 10/1991 |
| FR | 1515478 | 3/1968 |

OTHER PUBLICATIONS

International Search Report and Written Opinion, International Application No. PCT/US06/25802, dated Feb. 5, 2008.

*Primary Examiner* — Jennifer E. Novosad
(74) *Attorney, Agent, or Firm* — Michael Best & Friedrich LLP

(57) ABSTRACT

A shelving system having a top, bottom and intermediate shelves mounted on vertical supports. The intermediate shelves are mounted on adjustable brackets that permit individual removal of the intermediate shelves without disturbing the top and bottom shelves. The adjustable brackets comprise at one end a pin that is adapted to be inserted into a series of apertures formed along the length of each support. Opposite the pin, a mounting member is sized and shaped to receive a corner of each shelf. A stop is formed on the bracket between the pins and mounting member.

20 Claims, 11 Drawing Sheets

Related U.S. Application Data of application No. 11/993,198, filed as application No. PCT/US2006/025802 on Jun. 30, 2006, now Pat. No. 8,640,893.

(60) Provisional application No. 60/696,155, filed on Jul. 1, 2005.

(51) Int. Cl.

| | |
|---|---|
| ***A47B 57/00*** | (2006.01) |
| ***A47B 96/00*** | (2006.01) |
| ***A47B 57/56*** | (2006.01) |
| ***A47B 57/26*** | (2006.01) |
| ***A47B 57/50*** | (2006.01) |
| ***A47B 57/54*** | (2006.01) |
| ***A47B 96/06*** | (2006.01) |

(52) U.S. Cl.

CPC ..... *A47B 57/50* (2013.01); *A47B 57/545* (2013.01); *A47B 96/06* (2013.01); *A47B 96/068* (2013.01)

(58) Field of Classification Search

CPC ..... A47B 57/16; A47B 57/20; A47B 57/22; A47B 57/40; A47B 57/404; A47B 57/406; A47B 57/42; A47B 57/425; A47B 57/48; A47B 57/482; A47B 57/485; A47B 57/487; A47B 57/52; A47B 96/024; A47B 96/06; A47B 96/066; A47B 96/14; A47B 96/1408; A47B 96/1433; A47F 5/103; A47F 5/101

USPC ..... 211/187, 192, 103, 190, 207, 106.01, 211/196, 197, 181.1, 183; 248/218.4, 248/219.3, 219.4, 235, 304; 108/96, 106, 108/107, 110, 144.11, 147.11, 147.12, 108/147.13, 147.14, 147.15, 147.16, 108/147.17, 147.18

See application file for complete search history.

(56) References Cited

U.S. PATENT DOCUMENTS

| | | | | | |
|---|---|---|---|---|---|
| 3,358,956 | A | | 12/1967 | Thornton | |
| 3,479,975 | A | | 11/1969 | Ferdinand et al. | |
| 3,572,626 | A | | 3/1971 | Bertschi | |
| 3,757,705 | A | * | 9/1973 | Maslow | A47B 57/265 108/147.13 |
| 3,826,207 | A | | 7/1974 | Sutherlan | |
| 3,905,712 | A | | 9/1975 | McConnell | |
| 4,258,464 | A | | 3/1981 | Ullman, Jr. | |
| 4,367,819 | A | | 1/1983 | Lewis | |
| 4,627,543 | A | | 12/1986 | Nicely | |
| 4,799,818 | A | * | 1/1989 | Sudimak | A47B 57/545 108/147.13 |
| 5,080,238 | A | | 1/1992 | Hochman | |
| 5,116,007 | A | | 5/1992 | Von Gunton et al. | |
| 5,127,342 | A | * | 7/1992 | Taylor | A47B 57/265 108/147.13 |
| 5,265,740 | A | | 11/1993 | Hodsden et al. | |
| 5,415,302 | A | | 5/1995 | Carlson et al. | |
| 5,423,251 | A | | 6/1995 | Kolvites et al. | |
| 5,443,167 | A | | 8/1995 | Menaged et al. | |
| 5,624,045 | A | | 4/1997 | Highsmith et al. | |
| 5,653,349 | A | | 8/1997 | Dana et al. | |
| 5,924,581 | A | * | 7/1999 | Chen | A47B 57/26 211/187 |
| 5,957,060 | A | | 9/1999 | Rosenband | |
| 5,979,338 | A | | 11/1999 | Salmanson et al. | |
| 6,017,009 | A | | 1/2000 | Swartz et al. | |
| 6,068,143 | A | * | 5/2000 | Wang | A47B 57/265 108/144.11 |
| 6,079,575 | A | * | 6/2000 | Wang | A47B 57/265 108/110 |
| 6,182,937 | B1 | | 2/2001 | Sanderse | |
| 6,253,933 | B1 | * | 7/2001 | Yang | A47B 57/54 211/187 |
| 6,289,618 | B1 | | 9/2001 | Kump et al. | |
| 6,357,611 | B1 | * | 3/2002 | Chen | A47B 57/26 108/107 |
| 6,364,138 | B1 | * | 4/2002 | Chen | A47B 57/26 108/147.13 |
| 6,364,139 | B1 | * | 4/2002 | Chen | A47B 57/545 108/107 |
| 6,431,090 | B1 | | 8/2002 | Davis et al. | |
| 6,748,878 | B2 | * | 6/2004 | Chen | A47B 57/265 108/147.13 |
| 6,935,518 | B2 | | 8/2005 | Winig et al. | |
| 6,971,528 | B2 | | 12/2005 | Chen | |
| 7,284,671 | B1 | | 10/2007 | Doscher | |
| 7,478,971 | B2 | * | 1/2009 | Li | A47B 57/54 403/398 |
| 7,832,571 | B2 | | 11/2010 | Felsenthal | |
| 7,967,156 | B2 | | 6/2011 | Hsu | |
| 7,967,268 | B2 | | 6/2011 | Herron, III et al. | |
| 8,016,140 | B2 | * | 9/2011 | Hsieh | A47B 47/0083 211/187 |
| 8,118,181 | B2 | | 2/2012 | Shinozaki | |
| 8,286,564 | B2 | * | 10/2012 | Karl | A47B 57/545 108/107 |
| 8,640,893 | B2 | | 2/2014 | Kessell et al. | |
| 8,678,207 | B2 | * | 3/2014 | Shimazaki | A47B 57/545 108/147.13 |
| 9,167,915 | B1 | * | 10/2015 | Lau | A47B 47/00 |
| 9,179,774 | B2 | * | 11/2015 | Kessell | A47B 57/26 |
| 9,249,818 | B2 | * | 2/2016 | Sabounjian | A47B 57/265 |
| 9,314,098 | B2 | * | 4/2016 | Sabounjian | A47B 47/0083 |
| 9,468,292 | B2 | * | 10/2016 | Kuehn | A47B 57/34 |
| 2004/0065633 | A1 | * | 4/2004 | Chen | A47F 5/13 211/187 |
| 2005/0056604 | A1 | | 3/2005 | Chen | |
| 2005/0145147 | A1 | | 7/2005 | Costa et al. | |
| 2006/0091088 | A1 | | 5/2006 | McCoy | |
| 2008/0128373 | A1 | | 6/2008 | Chang et al. | |
| 2008/0142463 | A1 | | 6/2008 | Johnson | |
| 2009/0014400 | A1 | | 1/2009 | Nawrocki | |

* cited by examiner

ADJUSTABLE SHELVING SYSTEM

BACKGROUND OF THE INVENTION

The present invention relates to shelving systems, and especially to an adjustable bracket for a shelving system.

Wire frame shelving systems are well known in the art and are often used in commercial and other heavy-duty applications. Such shelving systems typically comprise a plurality of vertically spaced-apart shelves that are supported on posts or other vertical supports positioned at the corners of the shelves. The shelving system requires at least two shelves, one positioned near the top of the posts and the other near the bottom, thereby creating a box-like structure that provides stability and rigidity to the shelving system. Additional intermediate shelves are spaced between the top and bottom shelves.

The corners of the shelves are provided with ring-shaped connectors or collars that have frustoconical inner surfaces to receive the support posts. A series of horizontal grooves are formed along the length of each post to receive the interior rib of a tapered sleeve that is placed between the post and the corner shelf collars at a desired height to support the bottom and top shelves. To secure a shelf to the posts, a sleeve is placed at the same height along each of the posts with the interior sleeve rib engaged in a horizontal groove. The shelf is then lowered over the posts so that the corner collars slide down over the sleeves. The corner shelf collars squeeze the sleeves around the posts so that the interior rib of each sleeve tightly engages the support post, holding the shelf firmly in place.

Individual shelves are removed from the shelving system by lifting the shelf off the posts. However, an intermediate shelf cannot be removed from the shelving system without removing other shelves located above the shelf. A user must thus first remove the top shelf and any shelves disposed between the top shelf and the intermediate shelf that is desired to be removed before the intermediate shelf can be lifted off the posts. In addition to the extra work involved, removing the top shelf and possibly other shelves may also cause the shelving system to become unstable, particularly when the remaining shelves are still loaded with heavy items.

The inability to separately remove an intermediate shelf also makes it difficult to adjust its position. Once the sleeves are removed, the shelf must be manually supported in the shelving system while the sleeves are repositioned on the posts. Consequently, adjusting the position of a shelf can be an awkward, difficult operation that often requires two people to accomplish.

Accordingly, there is a need for a wire frame shelving system that provides for convenient removal and adjustment of intermediate shelves.

SUMMARY OF THE INVENTION

These needs and other needs are satisfied by a shelving system having an adjustable bracket for mounting a shelf on a vertical support. In some embodiments, the bracket has a mounting member for receiving a connector on the shelf, a coupling member for mounting the bracket on a vertical support, and a stop positioned between the mounting and coupling members.

Some embodiments of the present invention provide a bracket for supporting a shelf on a support post having an aperture, wherein the bracket comprises a first end shaped and dimensioned to be removably received within the aperture in the support post; and a second end opposite the first end and adapted to protrude from the aperture and to support the shelf.

In some embodiments, an adjustable shelving assembly is provided, and comprises a vertically-extending support post having a sidewall; an aperture defined in the sidewall of the vertically-extending support post; a bracket having a first end removably received within the aperture; and a second end opposite the first end and adapted to protrude from the aperture; and a shelf at least partially supported upon the second end of the bracket.

Some embodiments of the present invention provide a bracket for supporting a shelf on a support post, wherein the bracket comprises a first portion extending about and removably secured to the support post at a location along the support post; and a second portion extending outwardly from the first portion and adapted to support a shelf thereupon; wherein the first portion is movable to and releasably securable to different locations along the support post to support a shelf at different heights on the support post.

Further aspects of the present invention, together with the organization and operation thereof, will become apparent from the following detailed description of the invention when taken in conjunction with the accompanying drawings, wherein like elements have like numerals throughout the drawings.

DETAILED DESCRIPTION OF THE INVENTION

Figure 1:
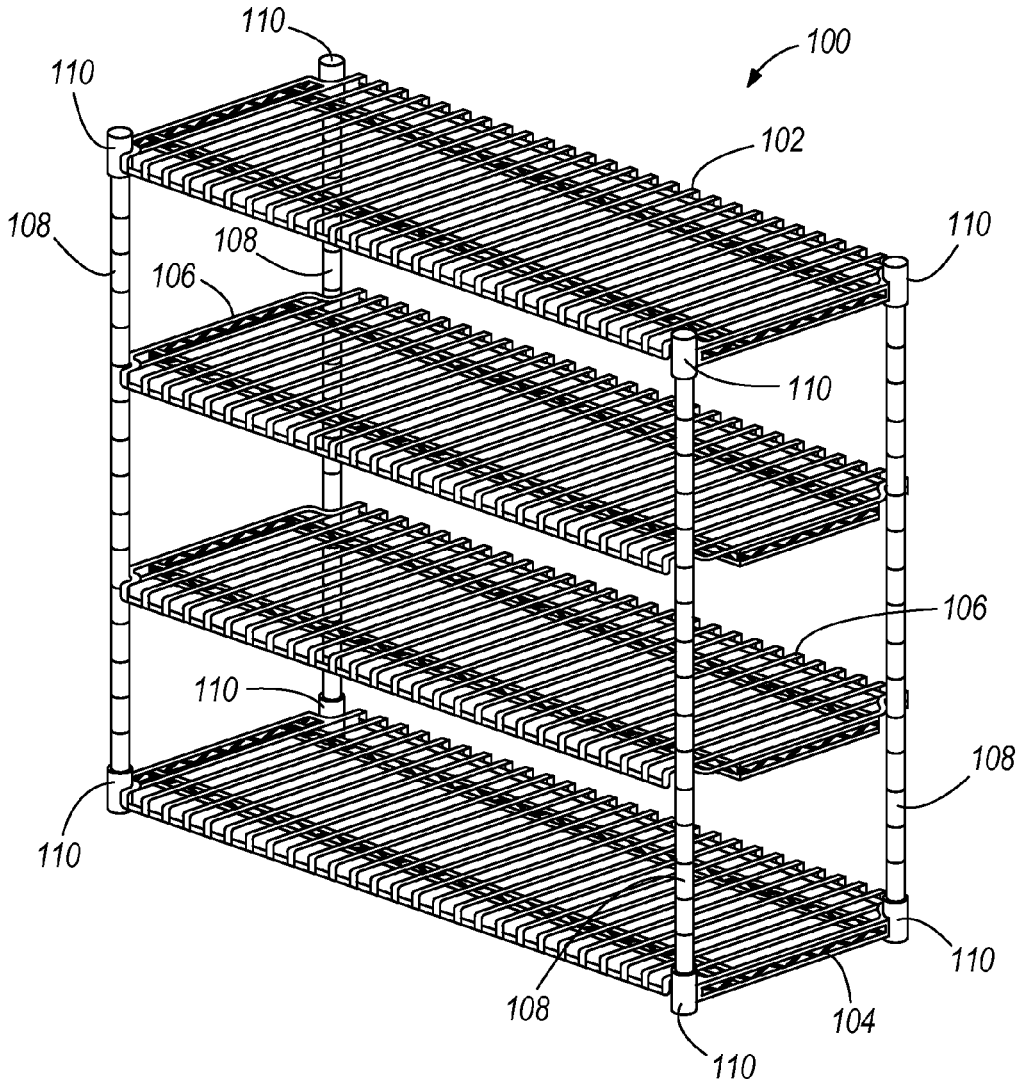
FIG. 1 is a perspective view of a shelving system.

Referring to FIGS. 1-10, a shelving system 100 is described, comprising vertically spaced top and bottom shelves 102, 104, and one or more intermediate shelves 106, that are mounted on vertical supports 108 positioned at the corners of the shelves. As shown in FIG. 1, top and bottom shelves 102, 104 may be mounted on vertical supports 108 by conventional ring-shaped connectors or collars 110 and sleeves (not shown) wedged between the connectors and the support posts 108. In the disclosed embodiment, the top and bottom shelves 102, 104 are provided with a frustoconical connector or collar 110 at each corner. A plurality of horizontal grooves are spaced along the length of each vertical support 108 to receive the rib formed on the inside surface of a frustoconical or tapered sleeve (not shown) that fits over the support 108 and inside the corner shelf connector 110. To secure a top or bottom shelf 102, 104 to the supports 108, a sleeve is mounted to each of the four supports 108 by placing the interior sleeve rib into a selected groove so that all four sleeves are mounted at the same elevation on each support. The shelf 102, 104 is then lowered onto the supports 108 with the corner connectors 110 fitting over the corresponding sleeves. As the shelf is brought down over the sleeves, the frustoconical corner connectors squeeze the tapered sleeves so that the inner rib of each sleeve tightly engages the groove formed in the vertical support 108 into which it has been inserted, securing the shelf to the support. The corner shelf connectors 110 thus grip the supports by means of the sleeves.

Figure 2:
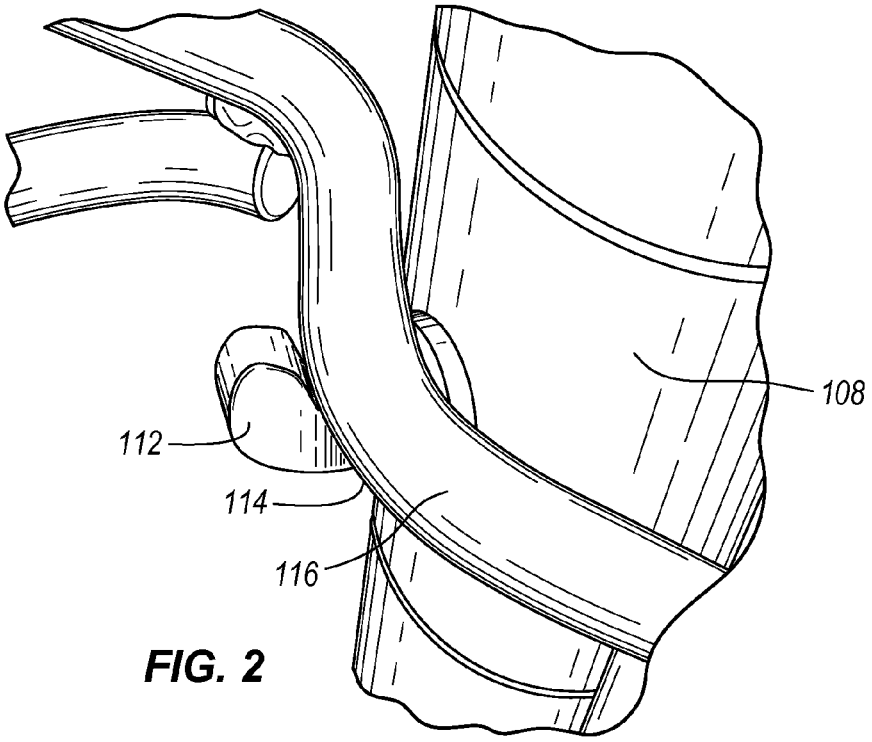
FIG. 2 is a top perspective detail view of the shelving system of FIG. 1, showing the corner of an intermediate shelf mounted on a vertical support by a bracket.
Figure 3:
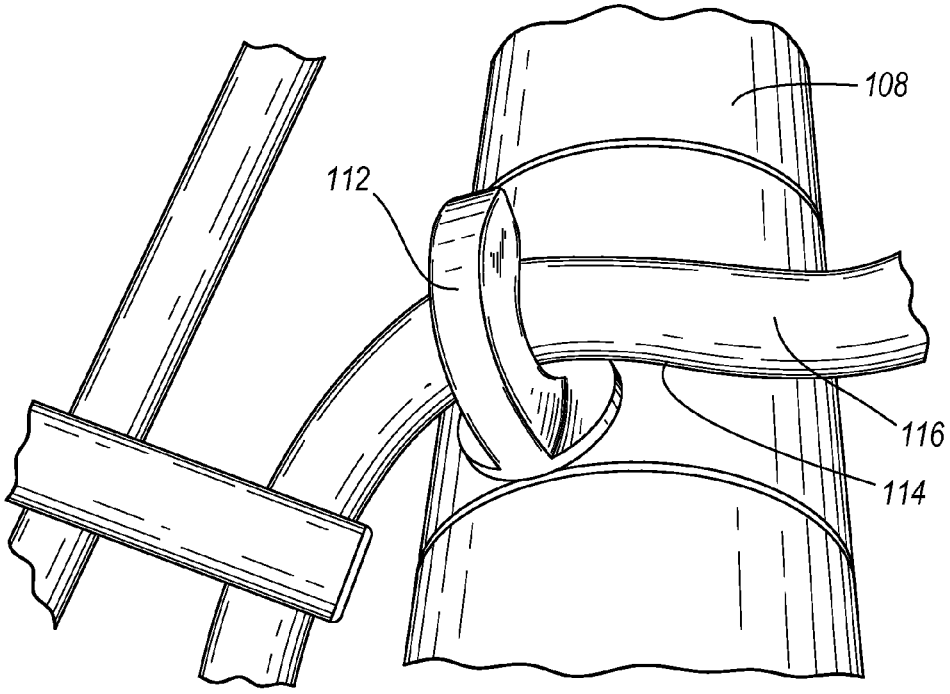
FIG. 3 is a bottom perspective detail view of the shelving system of FIG. 1, showing the corner of an intermediate shelf mounted on a vertical support by a bracket.

As shown in FIG. 2, intermediate shelves 106 are mounted on vertical supports 108 by adjustable brackets 112. The corners of intermediate shelves 106 are provided with connectors 114 in the form of a rod 116 that is received in brackets 112. In a preferred embodiment, rod 116 is curved or otherwise shaped to at least partly conform to the shape of vertical support 108.

Figure 8:
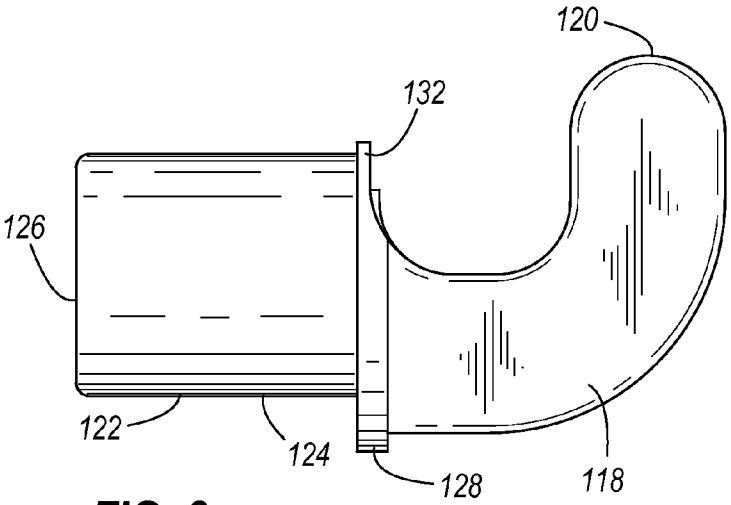
FIG. 8 is a side elevation view of the bracket of FIG. 6.
Figure 9:
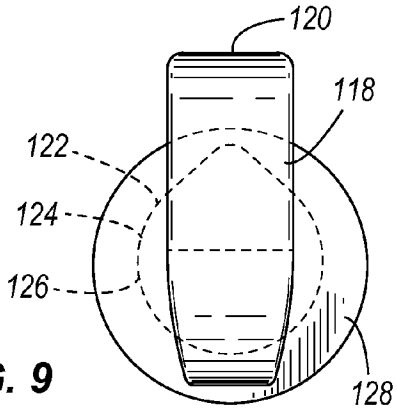
FIG. 9 is a front elevation view of the bracket of FIG. 6.
Figure 10:
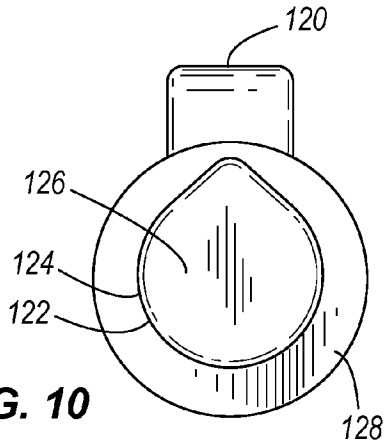
FIG. 10 is a rear elevation view of the bracket of FIG. 6.

As shown in FIGS. 6-10, brackets 112 have a first end 118 with a mounting member 120 for receiving a connector 114. In a preferred embodiment, mounting member 120 is hook-shaped and is sized to receive a rod 116 at the corner of an intermediate shelf 106. A coupling member 122 is formed at a second end 124 of bracket 112 for mounting the bracket 112 on vertical supports 108. In a preferred embodiment, coupling member 122 is a pin 126 having a rotationally asymmetric cross-section, as best shown in FIGS. 9 and 10. A stop 128 is formed on bracket 112 and is positioned between mounting member 120 and coupling member 122. At least a portion of stop 128 extends beyond the cross-section of pin 126 (FIGS. 9 and 10).

Figure 4:
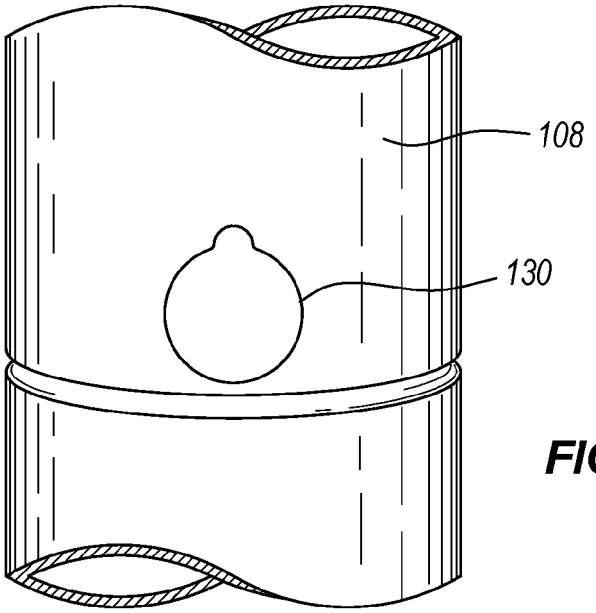
FIG. 4 is a detail front elevation view of a vertical support showing an aperture for receiving a bracket.

As shown in FIG. 4, vertical supports 108 are cylindrical (although they can be any other desired shape) and have a plurality of apertures 130 that are spaced along the length of the supports 108 on an inwardly facing surface. The apertures 130 are sized and shaped to receive pins 126. Brackets 112 are removably mounted on vertical supports 108 by inserting pin 126 into an aperture 130 up to stop 128. Because the cross-section of pins 126 is rotationally asymmetric to correspond with the shape of aperture 130, brackets 112 can only be mounted on vertical supports 108 in a single orientation and cannot rotate within apertures 130. This ensures that mounting member 120 on brackets 112 will always be oriented correctly to receive connectors 114 of intermediate shelves 106, and cannot inadvertently rotate out of position during use.

Figure 5:
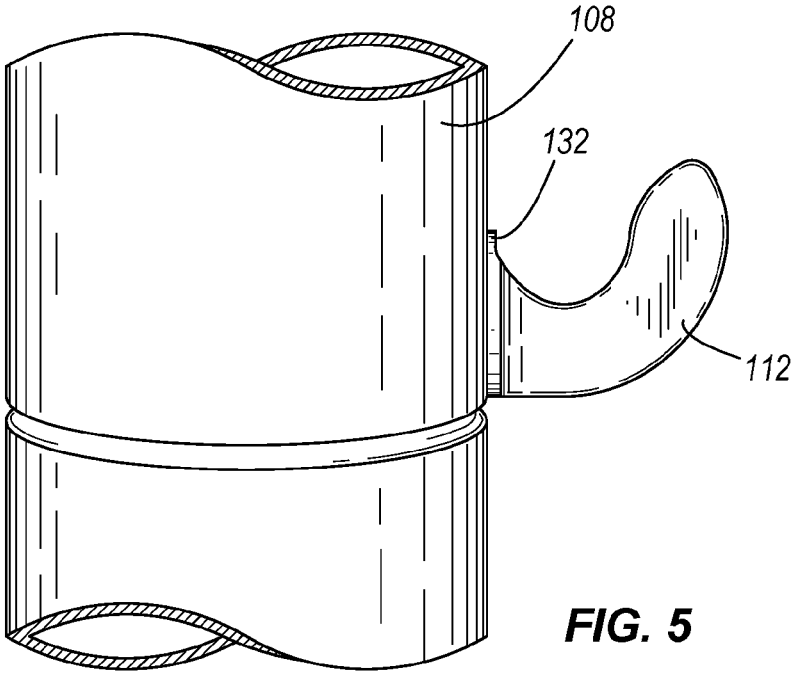
FIG. 5 is a detail side elevation view of a bracket mounted on a vertical support.
Figure 6:
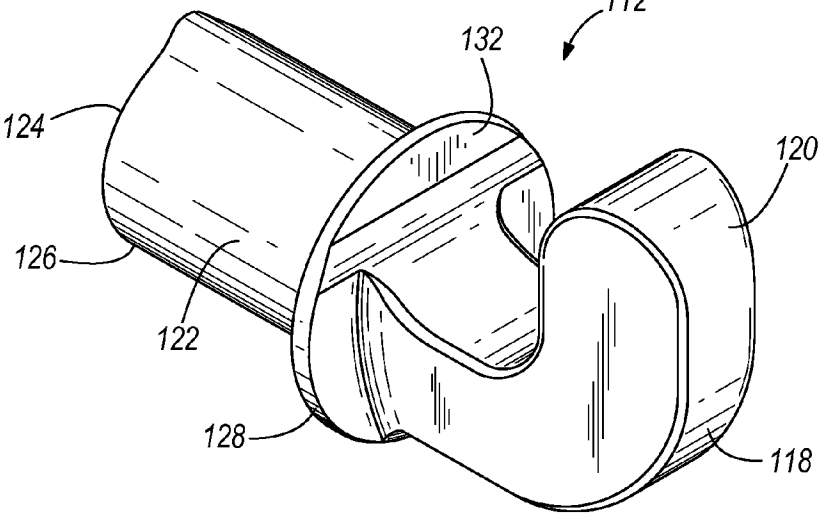
FIG. 6 is a perspective view of a bracket.
Figure 7:
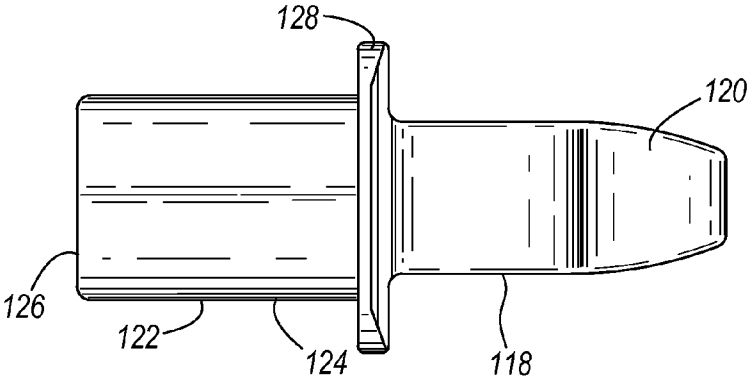
FIG. 7 is a top plan view of the bracket of FIG. 6.

Stop 128 ensures that pin 126 is inserted to the correct depth in aperture 130, such that mounting member 120 is available and properly positioned on vertical support 108 to receive connectors 114 of intermediate shelves 106. Stop 128 is generally disk-shaped with an inclined top edge 132 leading into the curved recess portion of hook-shaped mounting member 120. The inclined top edge of stop 128 thus forms a continuous, smooth transition surface with the recess formed by the hook-shaped mounting member 120 with no ridges or corners between the stop and the recess. (FIGS. 5, 6 and 8).

In a preferred embodiment, shelves 102, 104 and 106, vertical supports 108 and brackets 112 are all made of metal, such as steel or aluminum. In an alternative embodiment, one or more components of shelving system 100 may be made of other materials, such as plastic or wood.

Shelving system 100 is assembled by mounting shelves 102, 104 near the top and bottom of vertical supports 108 using conventional ring-shaped connectors 110 and insert sleeves (not shown) as described above to form a stable box-like structure. Brackets 112 are mounted on vertical supports 108, between top and bottom shelves 102, 104, by inserting pins 126 into the appropriate apertures 130 disposed at the desired elevations on each support 108. Each intermediate shelf 106 is then mounted on vertical supports 108 by engaging rods 116 disposed at the corners of each shelf in the hook-shaped mounting members 120 of brackets 112 that have been placed at the same elevation on supports 108.

Brackets 112 permit intermediate shelves 106 to be individually removed from or adjusted along the height of shelving system 100 without disturbing top and bottom shelves 102, 104 or any of the other shelves and compromising the stability of the shelving system. Intermediate shelves 106 are simply lifted up to disengage rods 116 from the hook-shaped mounting members 120 of brackets 112. If the position of intermediate shelves 106 is to be adjusted, the user removes and reinserts brackets 112 into the appropriate apertures 130 on vertical supports 108, and then reinstalls the intermediate shelf on the repositioned brackets 112.

It will be apparent to those skilled in the art that changes and modifications may be made in the embodiments illustrated herein, without departing from the spirit and the scope of the invention.

Figure 11:
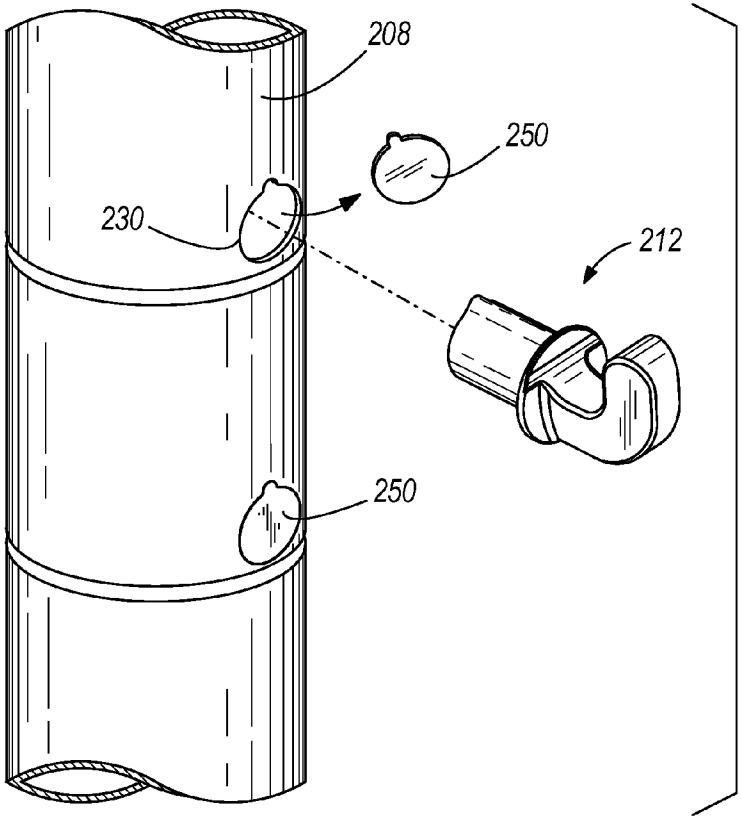
FIG. 11 is a front perspective detail view of a vertical support being adapted to receive a bracket.

Another embodiment of the present invention is illustrated in FIG. 11. In this embodiment, the vertical support 208 is provided with punch-outs 250. The punch-outs 250 can be produced by any suitable manufacturing process, such as by stamping, cutting, machining, and the like, and enable a user to punch out a portion of the vertical support 208 having a shape corresponding to an aperture 230 in which a bracket 212 is to be inserted as described above. In this manner, the user can open one or more apertures 230 at desired locations in vertical supports 208 at which an intermediate shelf (not shown) is to be installed. Accordingly, the number of apertures 230 in the vertical support 208 can be reduced or minimized—a feature that can be helpful in keeping the vertical support 208 and shelving system clean.

As mentioned above, the vertical supports 208 can be provided with punch-outs 250 in order to enable a user to select the locations for apertures 230 into which the brackets 212 will be installed. Any number of such punch-outs 250 can be located anywhere and at any regular or irregular spacing along the vertical supports 208. For example, the vertical supports 208 can be provided with two or more sets of regularly-spaced punch-outs 250, can be provided with regularly-spaced punch-outs 250 along the majority or substantially all of the length of the vertical supports 208, and the like.

Punch-outs 250 enable a user to easily form apertures 230 at desired locations in the vertical support 208. However, in other embodiments, such apertures 230 can be formed by the user in other manners, such as by a drill, punch, or other manual or power tool suitable for this task.

Figure 12A:
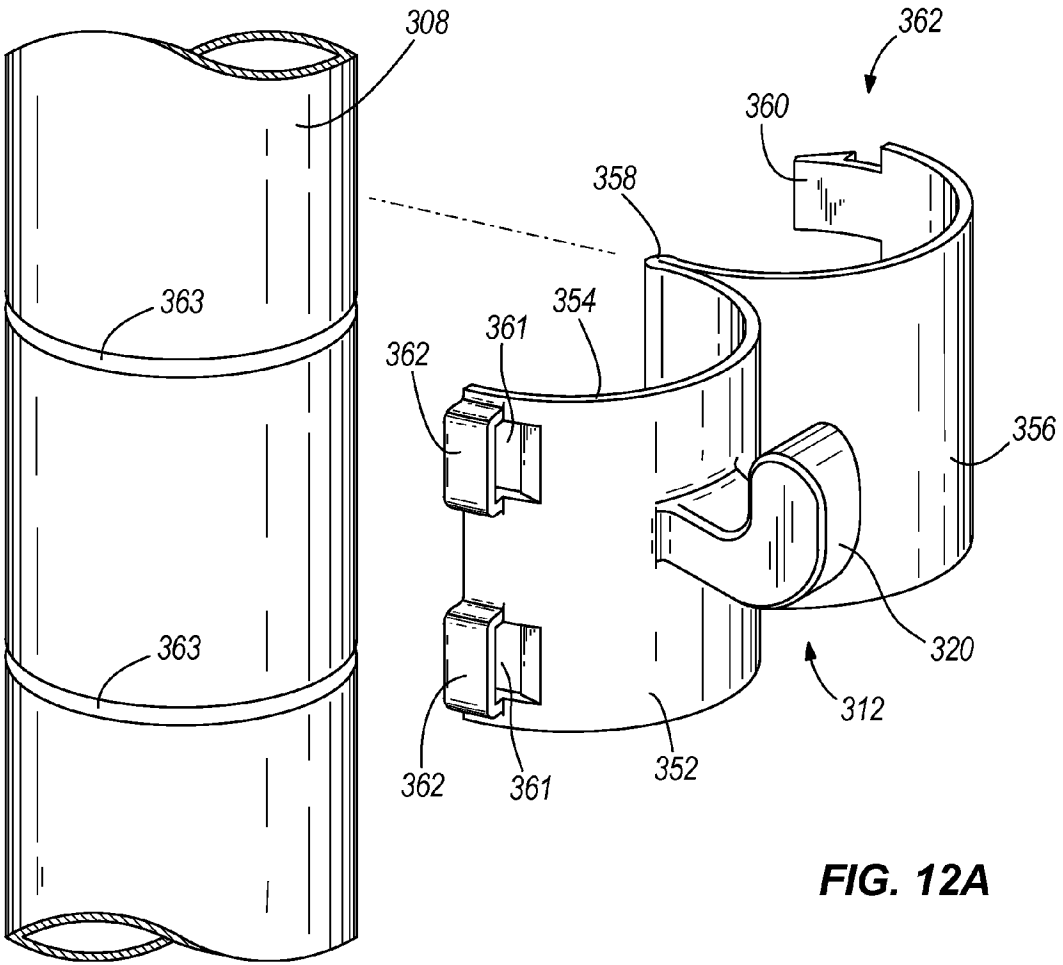
FIG. 12A is a front perspective exploded view of a vertical support and bracket according to another embodiment of the present invention.
Figure 12B:
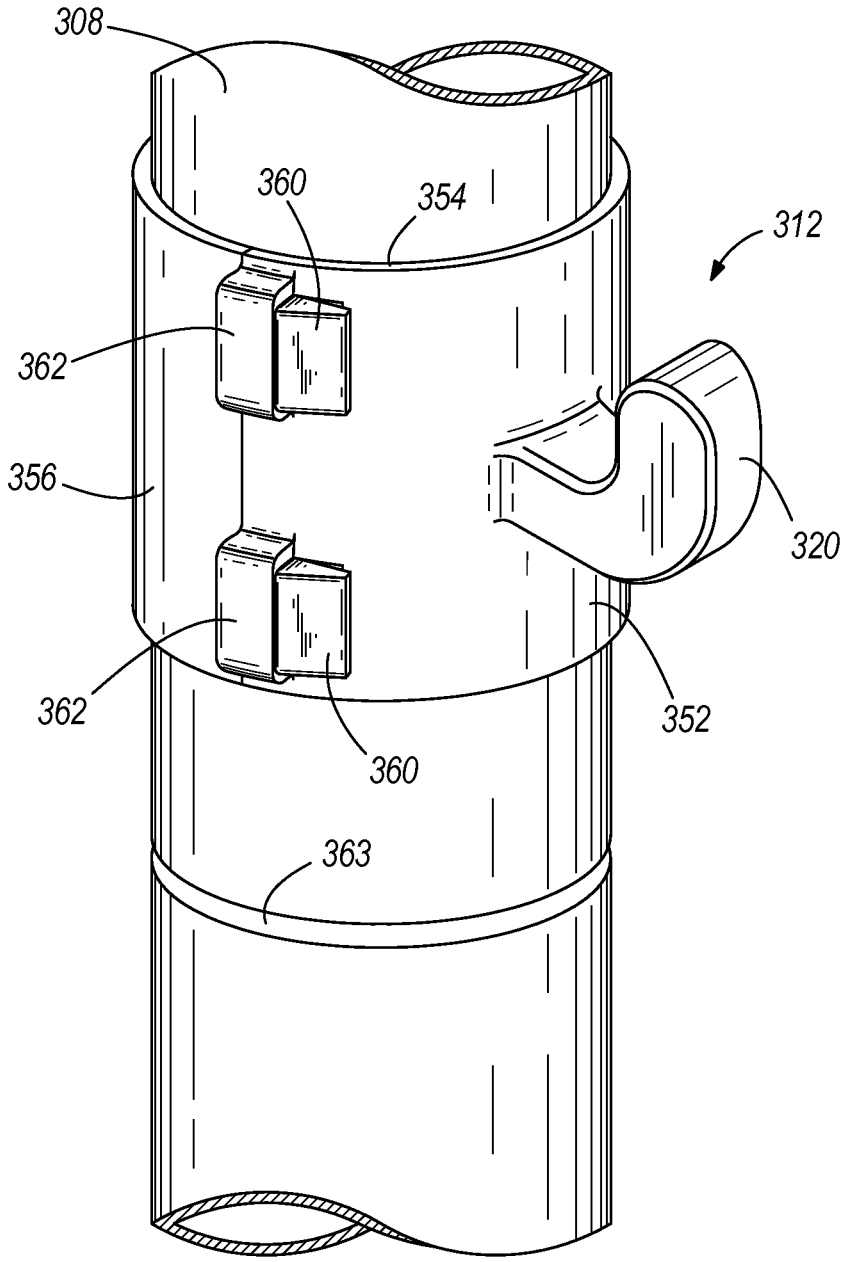
FIG. 12B is a front perspective assembled view of the vertical support and bracket of FIG. 12A.

Another embodiment of the present invention is illustrated in FIGS. 12A and 12B. In this embodiment, an end of the bracket 312 is not received within an aperture in a vertical support 308 in a manner as described above. Instead, the bracket 312 includes a collar 352 shaped to be received about the vertical support 308. The collar 352 can be installed about the vertical support 308 by having first and second portions 354, 356 connected together by a living or live hinge 358. In the illustrated embodiment of FIGS. 12A and 12B, for example, the live hinge 358 is defined by parts of the first and second portions 354, 356, which include material that is sufficiently deformable to enable a user to move the first and second portions 354, 356 with respect to one another. For example, part of all of the first and second portions 354, 356 defining the live hinge 358 illustrated in FIGS. 12A and 12B can be constructed of deformable plastic or metal, thereby enabling a user to open and close the bracket 312.

In other embodiments, the first and second portions 354, 356 are connected together by any other type of hinge, such as by a piano-type hinge, another type of pin and aperture hinge, and the like. In such embodiments, the first and second portions 354, 356 need not necessarily include material that is deformable, thereby expanding the types of possible materials used for the collar 352.

The first and second portions 354, 356 illustrated in FIGS. 12A and 12B are shown as being similar in shape, axial length, and circumferential size. However, in other embodiments, the first and second portions 354, 356 can both be longer or shorter, can be different lengths, and can have different circumferential sizes as desired.

To install the illustrated bracket 312 on a vertical support 308, a user opens the first and second portions 354, 356 of the bracket (if not already opened), places the bracket 312 at a desired location along the vertical support 308, then closes the first and second portions 354, 356 about the vertical support 308 at that location. A rib (not shown) can be provided on the interior surface of the first and/or second portion 354, 356, and can be received within a recess 360 in the vertical support 308, thereby providing a more positive engagement between the bracket 312 and the vertical support 308.

The bracket 312 can also be provided with one or more fasteners 362 to retain the bracket 312 in the desired location on the vertical support 308. The fastener(s) 362 can be located on the first and second portions 354, 356 of the bracket 312, and can take a number of different forms. For example, the bracket 312 illustrated in FIGS. 12A and 12B has a mating aperture 361 and projection 360 on the first and second portions 354, 356, respectively, although the locations of the projection 360 and aperture 361 can be reversed in other embodiments. The illustrated projection 360 is received in snap-fit engagement within the aperture 361, and can have any shape suitable for such engagement. In other embodiments, the fastener(s) 362 can take any other form, including without limitation a releasable buckle, clasp, hook and aperture set, and the like.

With continued reference to FIGS. 12A and 12B, the illustrated bracket 312 has a mounting member 320 similar to that in the embodiment of FIGS. 1-10. The mounting member 320 can be shaped to receive a connector of a shelf (not shown), in some embodiments is hook-shaped, and in some embodiments can be sized to receive a rod at the corner of an intermediate shelf (also not shown). The mounting member 320 can be integrally formed with the first or second portion 354, 356, or can be connected thereto in any manner, such as by welding, brazing, adhesive or cohesive bonding material, one or more rivets, screws, bolts, nails, pins, clamps, clasps, or other conventional fasteners, one or more inter-engaging elements (e.g., sliding dovetail connection, threaded connections, and the like), or in any other suitable manner.

Figure 13A:
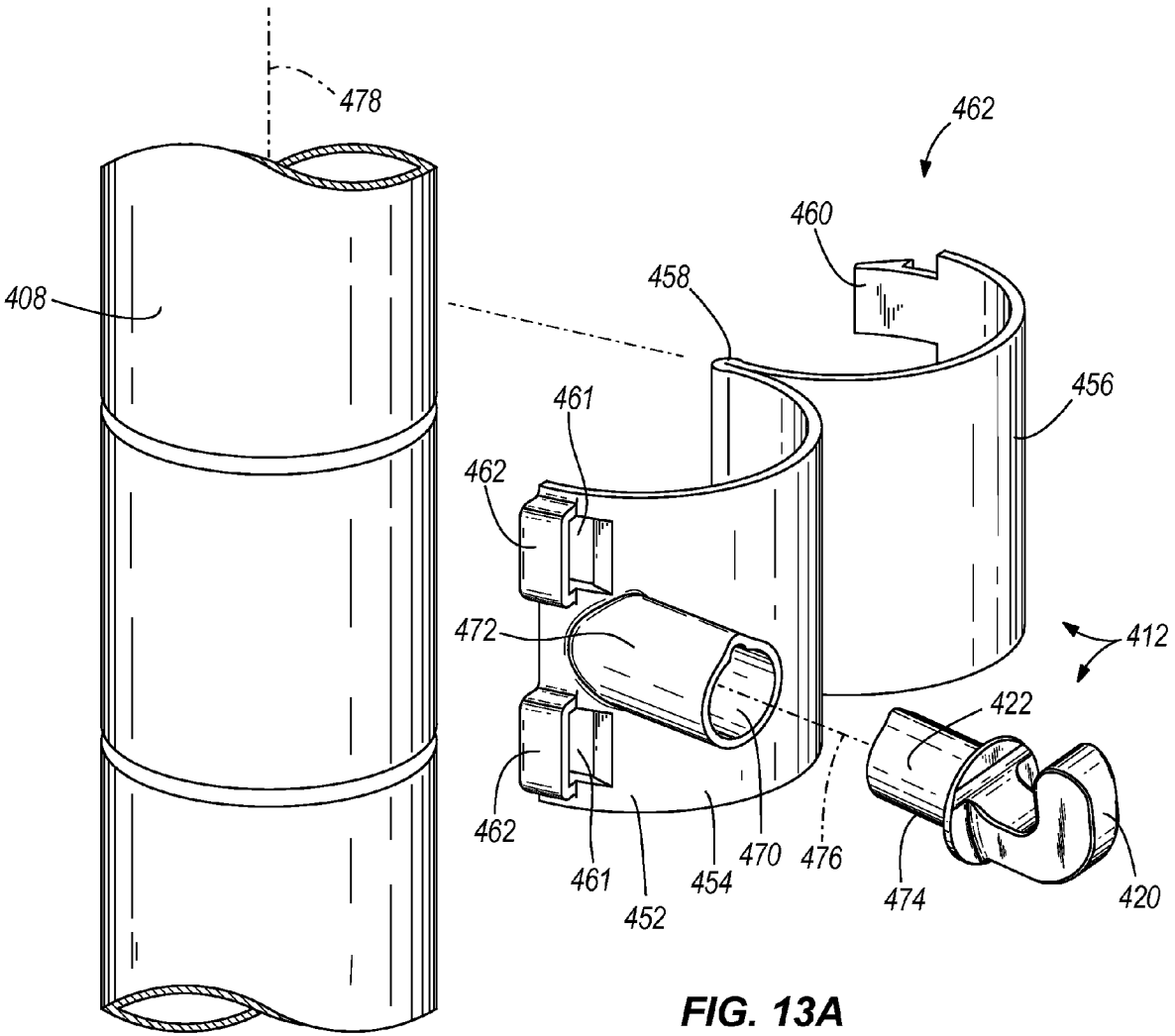
FIG. 13A is a front perspective exploded view of a vertical support and bracket according to another embodiment of the present invention.
Figure 13B:
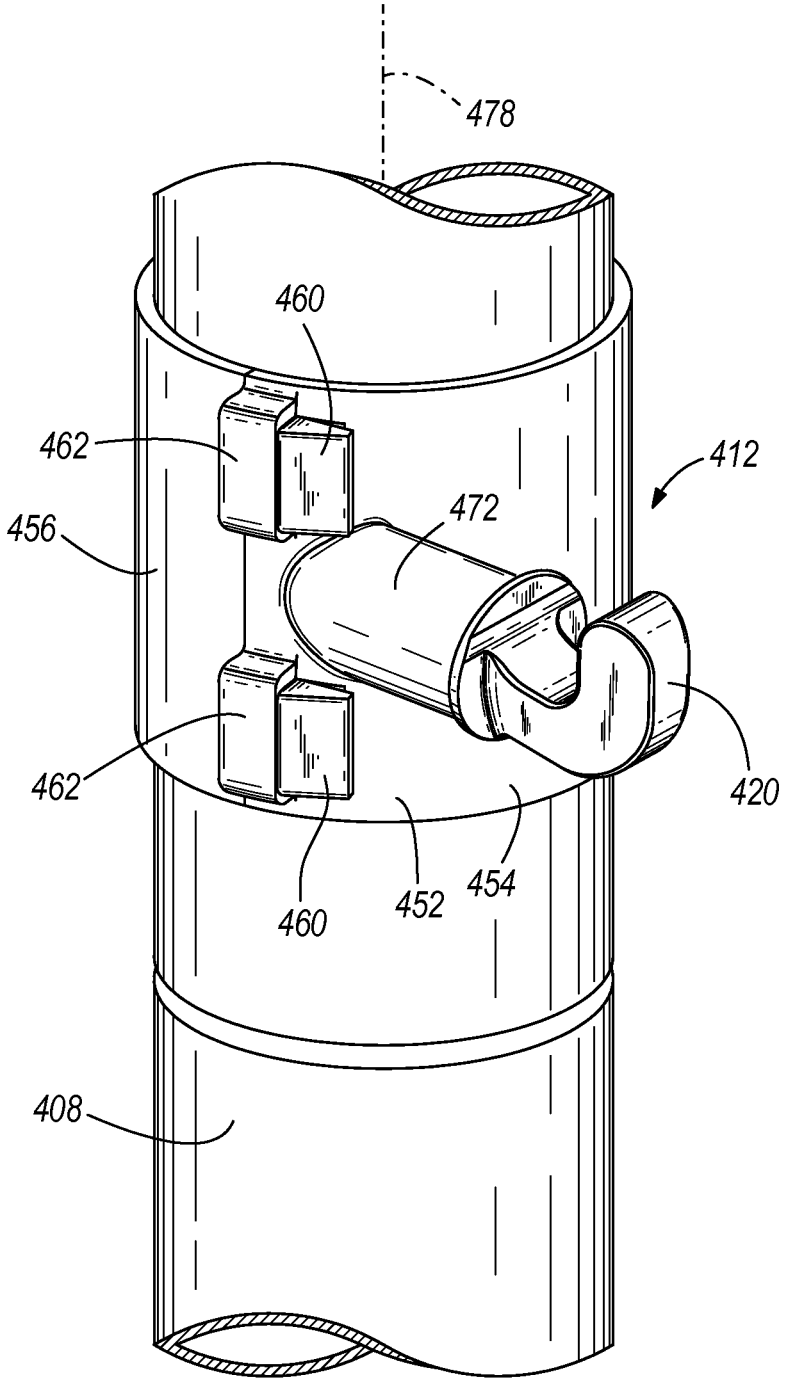
FIG. 13B is a front perspective assembled view of the vertical support and bracket of FIG. 13A.

Another embodiment of the present invention is illustrated in FIGS. 13A and 13B. In this embodiment, a bracket 412 similar in many ways to the bracket 312 illustrated in FIGS. 12A and 12B includes a collar 452 shaped to be received about the vertical support 408. The collar 452 can be installed about the vertical support 408 by having first and second portions 454, 456 connected together by a living or live hinge 458. The live hinge 458 can take any of the forms and be constructed in any of the manners described above in connection with the bracket 312 illustrated in FIGS. 12A and 12B.

In other embodiments, the first and second portions 454, 456 are connected together by any other type of hinge, such as by a piano-type hinge, another type of pin and aperture hinge, and the like. In such embodiments, the first and second portions 454, 456 need not necessarily include material that is deformable, thereby expanding the types of possible materials used for the collar 452.

The first and second portions 454, 456 illustrated in FIGS. 13A and 13B are shown as being similar in shape, axial length, and circumferential size. However, in other embodiments, the first and second portions 454, 456 can both be longer or shorter, can be different lengths, and can have different circumferential sizes as desired.

The bracket 412 can be installed in the same manner as described above in connection with the illustrated embodiment of FIGS. 12A and 12B, and can be retained on the vertical support 408 by any of the types of fasteners located in any of the manners also described above in connection with the illustrated embodiment of FIGS. 12A and 12B.

The bracket 412 illustrated in FIGS. 13A and 13B also has an aperture 470 similar in shape to the aperture 30 described above with reference to the embodiment of FIGS. 1-10. The aperture 470 is defined in the first portion 454 of the bracket 412, and can extend fully through the thickness of the first portion 454 or can be a blind aperture. Although the aperture 470 in the illustrated embodiment is in the first portion 454, the aperture 470 can instead be in the second portion 456. In some embodiments, the aperture 470 is defined in a boss, protrusion, or other relatively thick portion of the bracket 412, thereby enabling the aperture 470 to be relatively deep. For example, in embodiments of the present invention in which the first and second portions of the bracket 412 define a generally frustoconical shape when assembled on a vertical support 408, the aperture 470 can be located in a lower and thicker area of the first and/or second portions 454, 456. As another example, the aperture 470 in the illustrated embodiment of FIGS. 13A and 13B is defined in a boss 472 of the first portion 454.

With continued reference to FIGS. 13A and 13B, the illustrated bracket 412 also includes a separate portion 474 comprising a coupling member 422 and a mounting member 420 for receiving a connector as described in greater detail above in connection with other embodiments. The separate portion 474 is substantially the same as the bracket 112 in the illustrated embodiment of FIGS. 1-10.

The coupling member 422 of the separate portion 474 is shaped and dimensioned to be received within the aperture 470 in the first portion 454 of the bracket 412, thereby enabling a user to secure the coupling member 422 and mounting member 420 at a desired location along the length of the vertical support 408. In this regard, the deep shape of the aperture 470 (by virtue of the boss 472 as described above) enables the coupling member 422 to be received partially or fully within the aperture 470.

Figure 13C:
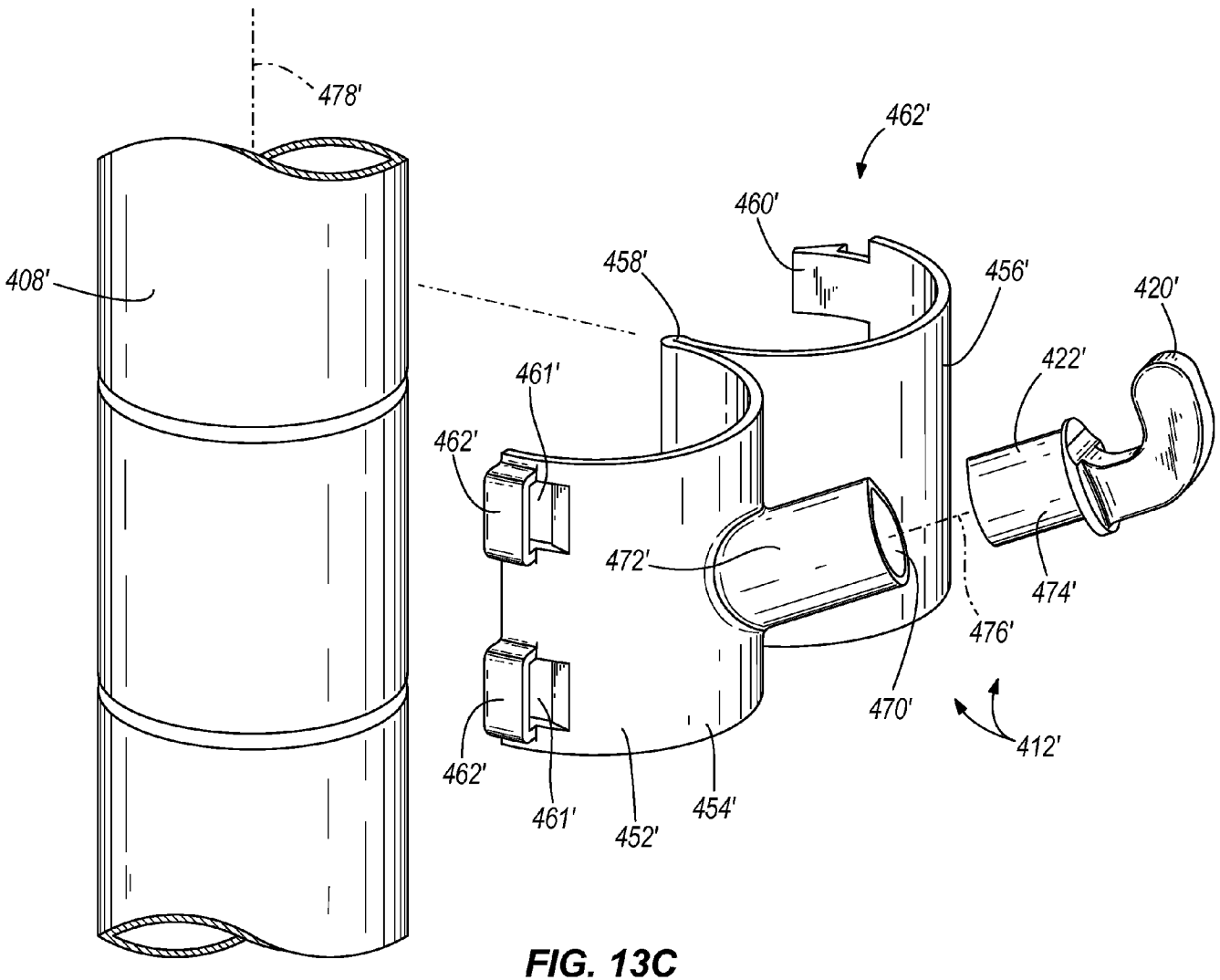
FIG. 13C is a front perspective exploded view of a vertical support and bracket according to another embodiment of the present invention.

In some embodiments, a relatively deep aperture 470 can be provided at least in part by the orientation of the aperture 470 with respect to the rest of the bracket 412 (and thereby, with respect to the vertical support 408). For example, the aperture 470 in the illustrated embodiment of FIGS. 13A and 13B is oriented to extend along an axis 476 that does not intersect the vertical support 408, or at least does not intersect the axis 478 of the vertical support 408 when the bracket 412 is installed upon the vertical support 408. By orienting the aperture 470 in this manner, the aperture 470 can be relatively deep, thereby providing a stronger and more stable connection to the coupling member 422 and/or enabling the overall radial size of the assembled bracket 412 to be reduced. It will be appreciated that the aperture 470 can be oriented in a number of different manners to achieve either or both of these goals. For example, the bracket 412' illustrated in FIG. 13C also has a relatively deep aperture 470' defined in a boss 472', wherein the aperture 470' is shaped and dimensioned to receive a coupling member 422' of a separate bracket portion 474' as described above in connection with FIGS. 13A and 13B. However, the elongated aperture 470' is oriented in a downwardly-sloping direction intersecting the axis 478' of the vertical support 408'. In addition to providing a stronger and more stable connection with the coupling member 422' as described above, the downwardly-sloping direction of the elongated aperture 470' can help further insure that the coupling member 422' remains engaged within the aperture 470'. Still other aperture locations and orientations are possible, and fall within the spirit and scope of the present invention.

Figure 14:
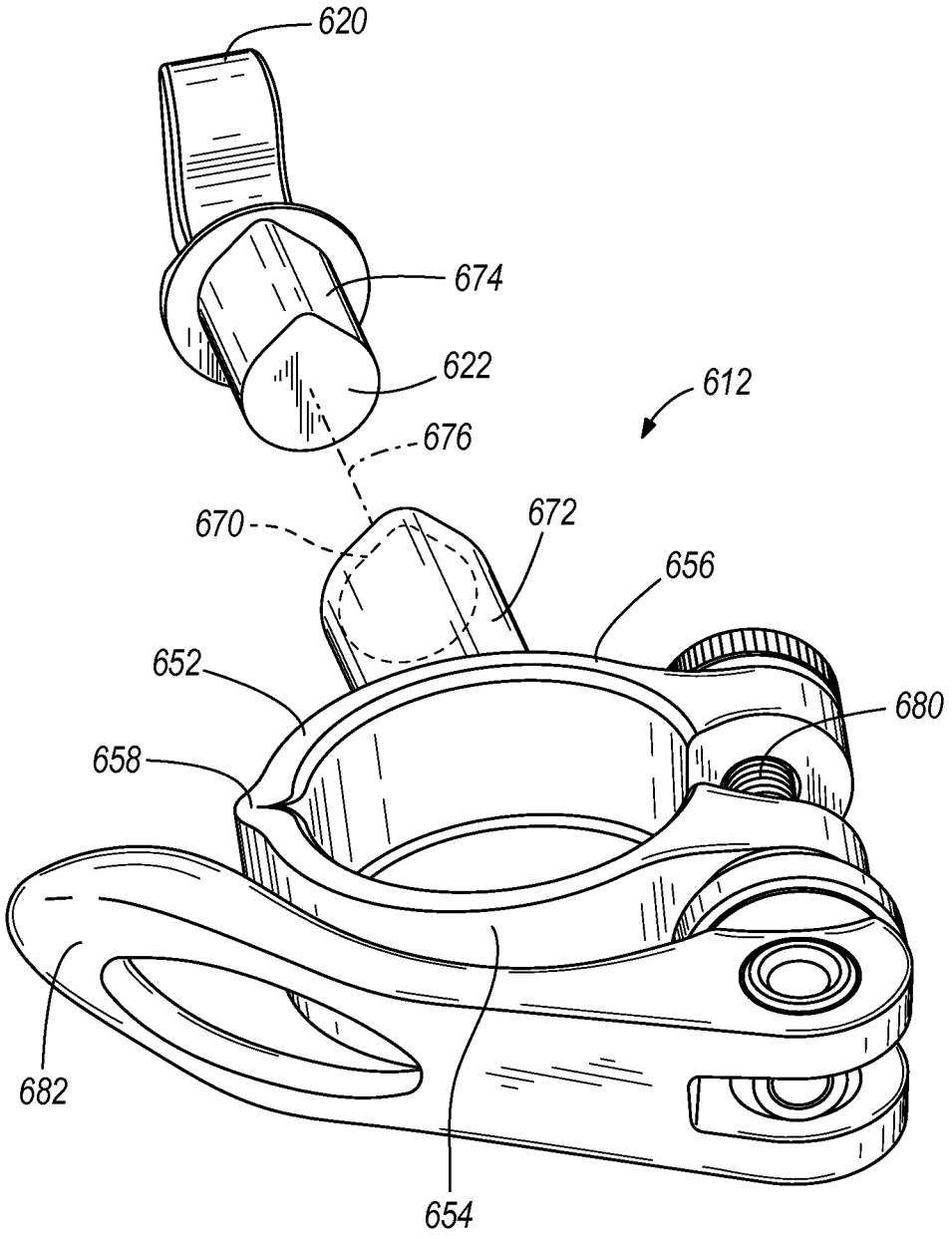
FIG. 14 is a perspective view of a bracket according to another embodiment of the present invention.

Yet another embodiment of the present invention is illustrated in FIG. 14. In this embodiment, the bracket 612 includes a collar 652 shaped to be received about a vertical support. Like the embodiments illustrated in FIGS. 13A-C, the collar 652 can be installed about a vertical support by having first and second portions 654, 656 connected together by a living or live hinge 658. The live hinge 658 can take any of the forms and be constructed in any of the manners described above in connection with the bracket 312 illustrated in FIGS. 12A and 12B.

In other embodiments, the first and second portions 654, 656 are connected together by any other type of hinge, such as by a piano-type hinge, another type of pin and aperture hinge, and the like. In such embodiments, the first and second portions 654, 656 need not necessarily include material that is deformable, thereby expanding the types of possible materials used for the collar 652.

The first and second portions 654, 656 illustrated in FIG. 14 are shown as being similar in shape, axial length, and circumferential size. However, in other embodiments, the first and second portions 654, 656 can both be longer or shorter, can be different lengths, and can have different circumferential sizes as desired.

The bracket 612 can be installed in the same manner as described above in connection with the illustrated embodiment of FIGS. 12A and 12B. However, the bracket 612 utilizes a threaded fastener 680 passing through apertures in the first and second portions 654, 656 to tighten the collar 652 on a vertical support. In other embodiments, the bracket 612 utilizes a different fastener (e.g., a pin or other fastener, rather than a threaded fastener) in order to releasably connect the first and second portions of the bracket 612. A cam lever 682 is pivotably connected to the threaded fastener 680 and can be pivoted to and past an over-center position in which the cam lever 682 is adjacent the collar 652. In this position, the cam lever 682 provides tension on the threaded fastener 680, thereby clamping the first and second portions 654, 656 upon a vertical support. The cam lever 682 can be pivoted in an opposite direction to loosen the collar 652 for movement to a different location on the vertical support 608.

To install the bracket 612 illustrated in FIG. 14 upon a vertical support, the user opens the bracket 612 by disconnecting the fastener 680 (e.g., unthreading the threaded fastener 680 from at least one of the first and second portions 654, 656) and spreading the first and second portions 654, 656 apart. Once the bracket 612 is placed in a desired position on a vertical support, the fastener 680 is used to fasten the first and second portions 654, 656, after which time the cam lever 682 is pivoted to the position shown in FIG. 14 in order to clamp the collar 652 on the vertical support.

The bracket 612 illustrated in FIG. 14 also has an aperture 670 similar in shape to the aperture 30 described above with reference to the embodiment of FIGS. 1-10. The aperture 670 is defined in the second portion 656 of the bracket 612, and can extend fully through the thickness of the second portion 656 or can be a blind aperture. Although the aperture 670 in the illustrated embodiment is in the second portion 656, the aperture 670 can instead be in the first portion 654. The aperture 670 can be defined in any part of the first or second portions 654, 656 described above with reference to the embodiments of FIGS. 13A-C. In the illustrated embodiment, for example, the aperture 670 is defined in a boss 672 of the second portion 656.

With continued reference to FIG. 14, the illustrated bracket 612 also includes a separate portion 674 comprising a coupling member 622 and a mounting member 620. The separate portion 674 is substantially the same as the bracket 112 in the illustrated embodiment of FIGS. 1-10, and has a coupling member 622 and a mounting member 620 for receiving a connector as described in greater detail above in connection with other embodiments.

The coupling member 622 of the separate portion 674 is shaped and dimensioned to be received within the aperture 670 in the second portion 656 of the bracket 612, thereby enabling a user to secure the coupling member 622 and mounting member 620 at a desired location along the length of a vertical support. In this regard, the deep shape of the aperture 670 (by virtue of the boss 672 as described above) enables the coupling member 622 to be received partially or fully within the aperture 670.

Like the embodiments described above in connection with FIGS. 13A-C, a relatively deep aperture 670 can be provided at least in part by the orientation of the aperture 670 with respect to the rest of the bracket 612 (and thereby, with respect to a vertical support). The aperture 670 illustrated in FIG. 14 extends along an axis 676 that intersects the axis of a vertical support to which the bracket 612 is mounted. However, the aperture 670 can be oriented in any of the other manners described herein.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, in some embodiments, the collars 352, 452, 552, 652 of the embodiments described above in connection with FIGS. 13A-C, and 14 need not necessarily have a hinge in order to be opened for receiving a vertical support 308, 408, 508. In some embodiments, the bracket 312, 412, 512, 612 can be constructed of material that is sufficiently flexible to enable a user to deform the bracket 312, 412, 512, 612 and to thereby install the bracket 312, 412, 512, 612 about a vertical support 308, 408, 508. Also, in some embodiments, the collar 352, 452, 552, 652 can be defined by two or more elements not connected by a hinge, such as separate elements connected together at adjacent edges by one or more releasable fasteners. Any of the types of fasteners described herein can be utilized for this purpose.

We claim:

1. A bracket for supporting a shelf on a support post having a longitudinal axis, the bracket comprising:

a first portion adapted to extend about and be removably secured to the support post at different locations along the support post, wherein the first portion is a collar that can be opened and closed via a hinge and includes a fastener that is adapted to releasably hold the collar closed about the support post to removably secure the collar to the different locations along the support post, and wherein the collar comprises a first portion and a second portion, and the hinge is defined by and disposed between the first portion and second portion;

an elongated second portion having a longitudinal axis extending outwardly from the first portion in a direction orthogonal to the longitudinal axis of the support post when the first portion is removably secured to the support post, wherein the second portion is adapted to support a shelf; and an aperture defined in the first portion and in which the second portion is removably received, wherein the aperture is elongated and extends orthogonal with respect to the longitudinal axis of the support post.

2. The bracket of claim 1, wherein the hinge is a living hinge.

3. The bracket of claim 1, wherein the second portion comprises a hook.

4. The bracket of claim 1, wherein the second portion is shaped to prevent rotation of the second portion within the aperture.

5. The bracket of claim 1, wherein the aperture has a non-circular shape.

6. The bracket of claim 1, wherein the second portion has a first section adapted to be received in the aperture and a second elongated section extending away from the first section adapted to support a shelf.

7. The bracket of claim 6, wherein the first and second sections of the second portion have different cross-sections.

8. A bracket for supporting a shelf on a support post having a longitudinal axis, the bracket comprising:

a first member adapted to be removably secured to the support post at different locations along the support post, wherein the first member includes an aperture having a longitudinal axis orthogonal to the longitudinal axis of the support post; and a second member adapted to extend outwardly from the aperture in the first member and removably support a shelf;

wherein the first member is a collar that can be opened and closed via a hinge and is adapted to be releasably secured to the different locations along the support post, and wherein the collar comprises a first portion and a second portion, and the hinge is defined by and disposed between the first portion and second portion.

9. The bracket of claim 8, wherein the second member is adapted to be removably received in the aperture of the first member.

10. The bracket of claim 9, wherein the aperture has a non-circular shape.

11. The bracket of claim 10, wherein the second member includes a stop to limit an amount of insertion of the second member into the aperture.

12. The bracket of claim 11, wherein the stop has opposed first and second sides, and the first side of the stop is adapted to abut the first member when the second member is removably received in the aperture, wherein the second member has a first portion extending from the first side of the stop and which is adapted to be received in the aperture and a second portion extending from the second side of the stop, wherein the first and second portions of the second member have different cross-sections.

13. The bracket of claim 8, wherein the second member has a first portion adapted to be received in the aperture and a second elongated portion extending away from the first portion adapted to support a shelf.

14. The bracket of claim 13, wherein the first and second portions of the second member have different cross-sections.

15. A bracket for supporting a shelf on a support post, the bracket comprising:

a first member adapted to be removably secured to the support post at a location along the support post, wherein the first member includes an aperture having a non-circular cross section; and a second member having a first portion with a non-circular cross section corresponding to the cross section of the aperture and adapted to be received in the aperture, a second portion extending away from the first portion, wherein the second portion is configured to protrude from the first member when the first portion is received in the aperture and to support a shelf, and a third portion disposed between the first portion and second portion, wherein the third portion has first and second opposed sides and the first side abuts the first member when the first portion is received in the aperture and the third portion is configured to limit the amount of insertion of the second member within the aperture.

16. The bracket of claim 15, wherein the aperture is elongated and extends at an upward angle with respect to the longitudinal axis of the support post.

17. The bracket of claim 15, wherein the second member is adapted to be removably received in the aperture of the first member.

18. The bracket of claim 15, wherein the first and second portions of the second member have different cross-sections.

19. The bracket of claim 15, wherein the second portion comprises a hook.

20. A bracket for supporting a shelf on a support post having a longitudinal axis, the bracket comprising:

a first member adapted to be removably secured to the support post at different locations along the support post, wherein the first member includes an aperture having a non-circular shape and longitudinal axis orthogonal to the longitudinal axis of the support post; and a second member adapted to be removably received in the aperture in the first member and to extend outwardly from the aperture and to support a shelf, wherein the second member includes a stop having opposed first and second sides to limit an amount of insertion of the second member into the aperture, and the first side of the stop is adapted to abut the first member when the second member is removably received in the aperture, wherein the second member has a first portion extending from the first side of the stop and which is adapted to be removably received in the aperture and a second portion extending from the second side of the stop, wherein the first and second portions of the second member have different cross-sections, wherein the first member is a collar that can be opened and closed via a hinge and is adapted to be releasably secured to the different locations along the support post.

* * * * *